US007025569B2

(12) United States Patent
Chang et al.

(10) Patent No.: US 7,025,569 B2
(45) Date of Patent: Apr. 11, 2006

(54) AXIAL FLOW FAN WITH MULTIPLE SEGMENT BLADES

(75) Inventors: Shun-Chen Chang, Ying Ko (TW); Kuo-Cheng Lin, Tao Yuan (TW); Wen-Shi Huang, Taoyuan (TW)

(73) Assignee: Delta Electronics, Inc. (TW)

( * ) Notice: Subject to any disclaimer, the term of this patent is extended or adjusted under 35 U.S.C. 154(b) by 13 days.

(21) Appl. No.: 10/321,468

(22) Filed: Dec. 18, 2002

(65) Prior Publication Data

US 2004/0062654 A1 Apr. 1, 2004

(30) Foreign Application Priority Data

Sep. 27, 2002 (TW) ..... 91122441 A

(51) Int. Cl.
*B63H 1/16* (2006.01)

(52) U.S. Cl. ..... 416/183; 416/198 R; 416/200 R; 416/212 R; 416/214 R; 416/231 B

(58) Field of Classification Search ..... 416/183, 416/231 B, 200 R, 198 R, 212 R, 214 R
See application file for complete search history.

(56) References Cited

U.S. PATENT DOCUMENTS 1,344,496 A * 6/1920 Flattum ..... 416/200 R
1,485,649 A * 3/1924 Van ..... 416/183
1,926,225 A * 9/1933 Birmann ..... 416/183
2,514,487 A * 7/1950 Griese ..... 416/231 R
2,859,933 A * 11/1958 Whitaker ..... 416/183
3,075,743 A * 1/1963 Sheets ..... 415/220
3,244,400 A * 4/1966 Selden ..... 416/231 R
4,167,369 A * 9/1979 Ishihara ..... 416/183
4,502,837 A 3/1985 Blair et al.
4,687,416 A 8/1987 Spranger

FOREIGN PATENT DOCUMENTS

| | | |
|---|---|---|
| JP | 10-66305 | 3/1998 |
| TW | 388203 | 4/1989 |
| TW | 488497 | 5/2002 |

* cited by examiner

*Primary Examiner*—Theresa Trieu

(57) ABSTRACT

An axial flow fan with a plurality of segment blades is described. The axial flow fan has a base, a hub and a plurality of blade units. The hub is mounted on, or pivots on, the base and supports the blade units. Each of the blade units is connected to a periphery of the hub and extends radially outward from the base has a plurality of segment blades. A segment space between the segment blades reforms a boundary layer of fluid passing over the segment blades and reduces the thickness of the boundary layer on the blade surfaces. As a result, the separation between the blade surfaces and fluid is avoided to maintain a laminar flow of the fluid adjacent to the segment blades.

18 Claims, 4 Drawing Sheets

AXIAL FLOW FAN WITH MULTIPLE SEGMENT BLADES

FIELD OF THE INVENTION

The present invention generally relates to blades, and more particularly, to an axial flow fan with multiple segment blades.

BACKGROUND OF THE INVENTION

Application of fans is increasing along with the rapid development of industrial techniques. For example, fans in heat exchangers or computer equipment can make a temperature therewithin drop. Specifically, an axial flow fan directly blows air over the computer equipment or rapidly circulates the air to cool the equipment.

FIG. 1 shows a three-dimensional view of the blades of the axial flow fan the prior art. The axial flow fan has a hub 100 and a plurality of blades 102. Each of the blades 102 equally extends from periphery 104 of the hub 100. Air drifts into the region of the blades 102 and then the air around the blades 102 is compressed to form airflow when the axial flow fan spins in a direction 106.

FIG. 2 shows a cross-sectional view of a blade 102 of the axial flow fan depicted in FIG. 1. An incident angle 112 is defined as an angle between a line 108 and the flow direction 110 of the air. The line 108 is drawn between a leading edge and a rear edge. There is a separation between the air and the surface of the blades 102 resulting in a stall effect when the incident angle 112 increases up to a specific angle. Turbulence is then formed on the upper surface of the blades 102. Since the stall effect reduces the work generated by the blades, the efficiency of the axial flow fan is severely decreased.

SUMMARY OF THE INVENTION

One object of the present invention is an axial flow fan with multiple segment blades that reforms a boundary layer of fluid on the segment blades to reduce the thickness of the boundary layer thereon. As a result, the prevention of the separation effect between the segment blades and the fluid maintains a laminar flow of the fluid adjacent to the segment blades.

Another object of the present invention is that the total incident angles of a blade unit be divided into a plurality of incident angles of a segment blade to reduce sequentially fluid impact against the surface region of the blades by the incident angles of the segment blades.

Yet another object of the present invention is the ability of the fluid resistance reduction on the surface region of the segment blades to decrease the operation current of an axial flow fan.

According to the above objects, the present invention sets forth an axial flow fan with multiple segment blades. The axial flow fan typically includes a hub and a plurality of blade units. The hub is used to support the blade units. The blade units connect to a periphery of the hub and extend radially outward from the periphery of the hub. Each of the blade units at least includes a first blade and a second blade. A segment space between the first blade and the second blade reforms the boundary layer passing through the first blade and the second blade. The thickness of the boundary layer on the segment blades therefore becomes thinner to prevent segment blades and the fluid from manifesting the separation effect.

In one preferred embodiment of the present invention, the axial flow fan has a frame base, a hub and a plurality of blade units. The hub is pivotally connected to the frame base and supports the blade units. The blade units are connected to a periphery of the hub and extend radially outward from the periphery of the hub. Each of the blade units at least has a plurality of blades. A segment space between the first blade and the second blade maintains a laminar flow of the fluid passed through the surface of the blades by a boundary layer reformation.

In another preferred embodiment of the present invention, the axial flow fan with multiple segment blades has a frame base, a hub, a plurality of rotating blade units and a plurality of still blade units. The hub is attached to the frame base and pivots thereon; the rotating blade units extend from the hub. The still blade units mounted on the frame base form a stationary structure. Each of still blade units has a plurality of segment blades. A segment space between the first blade and the second blade can prevent the surface of the still blade units and the fluid from separating.

Typically, the axial flow fan utilizes the still blade units and rotating blade units, such as the above-mentioned segment blades or a single segment blade. The still blade units mounted on the frame base align the rotating blade units during assembly of the axial flow fan. The still blade units and the frame base are at rest when the axial flow fan is in operation. The fluid is then introduced onto the rotating blades so that the fluid is gradually compressed for a fluid transmission.

In summary, the present invention utilizes an axial flow fan with multiple segment blades to reduce the thickness of the boundary layer by reforming the boundary layer on the surface of the segment blades. Further, the total incident angles of a blade unit are divided into a plurality of incident angles of a segment blade to reduce sequentially fluid impact against the surface region of the blade units. More importantly, the segment blades can be used to reduce resistance on the surface so as to decrease operation current for lower power consumption when the axial flow fan is in operation.

BRIEF DESCRIPTION OF THE INVENTION

The foregoing aspects and many of the attendant advantages of this invention will become more readily appreciated as the same becomes better understood by reference to the following detailed description when taken in conjunction with the accompanying drawings, wherein.

DETAILED DESCRIPTION OF THE PREFERRED INVENTION

The present invention is directed to an axial flow fan with multiple segment blades to introduce fluid by a plurality of blade units positioned around the periphery of a hub. A boundary layer of fluid passed through the segment blades is reformed to reduce the thickness of the boundary layer on the surfaces of the segment blades. As a result, the prevention of the separation effect between the segment blades and the fluid maintains a laminar flow of the fluid adjacent to the segment blades.

Additionally, the total incident angles of a blade unit are divided into a plurality of incident angles of a segment blade to sequentially reduce fluid impact against the surface region of the blade units by the incident angles of the segment blades, respectively. The segment blades can further reduce resistance on the surface region of the segment blades to save the operation current of the blade units. The segment blades are suitable for an axial flow fan or other type of fan and the fluid is air or liquid in the present invention.

Figure 1:
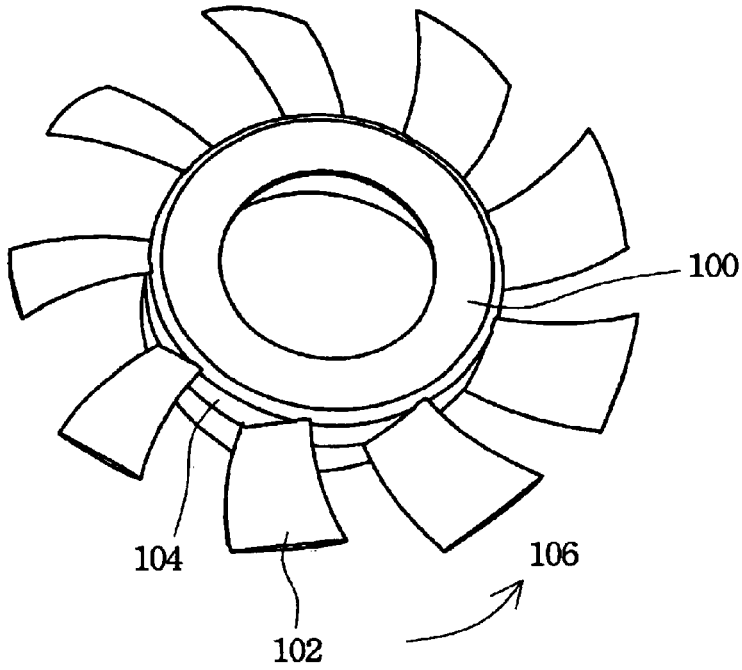
FIG. 1 (PRIOR ART)
FIG. 1 illustrates a three-dimensional view of the blades of an axial flow fan according to the prior art.
Figure 2:
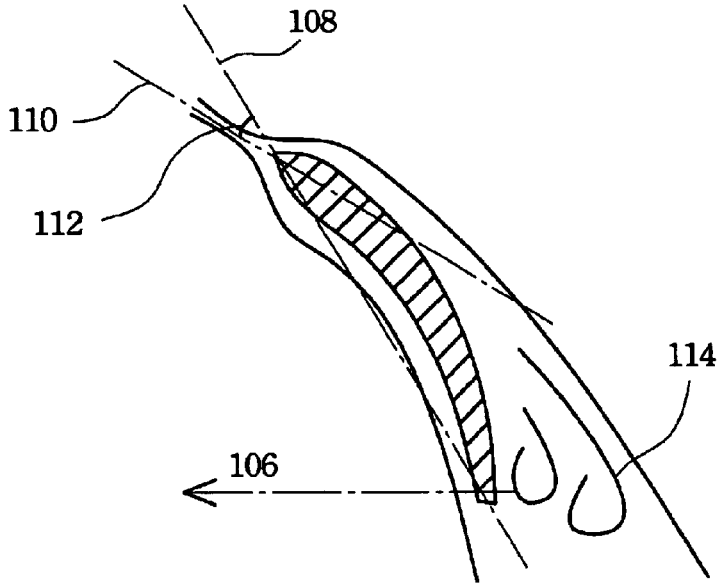
FIG. 2 (PRIOR ART)
FIG. 2 illustrates a cross-sectional view of a blade of the axial flow fan in FIG. 1 depicted in the prior art.
Figure 3:
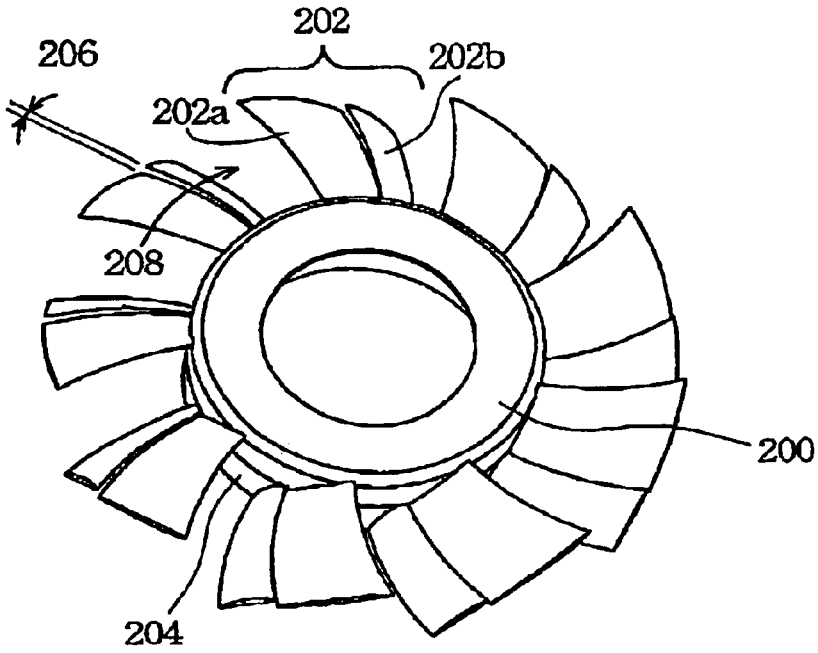
FIG. 3 illustrates a three-dimensional view of the segment blades of an axial flow fan in accordance with the present invention.

FIG. 3 shows a three-dimensional view of the blade structure of an axial flow fan in accordance with the present invention. The blade structure typically has a hub 200 and a plurality of blade units 202. The hub 200 supports the segment blades of each blade unit 202. The blade units 202 connect to a periphery of the hub 200 and extend radially outward from the periphery 204 of the hub 200. Each of the blade units 202 at least includes a first blade 20*a* and a second blade 202*b*. A segment space 206 between the first blade 202*a* and the second blade 202*b* keeps the fluid passing over the surface of the first blade 202*a* and through the second blade 202*b* laminar.

In the preferred embodiment of the present invention, each of blade units 202 is arranged along the rim of the hub 200 with spaces separating the blade units 202. Each of the blade units 202 has two or more segment blades 202*a*, 202*b*. Segment space 206 in flow direction 208 creates a state of separation or overlap between first blade 202*a* and second blade 202*b*. A state of overlap circulates readily the fluid on the segment blades.

In the present invention, the segment blades 202*a*, 202*b* of the blade units 202 introduce the fluid so as to reform a boundary layer of fluid, passed through the first blade 202*a* and the second blade 202*b*, for a thickness reduction of boundary layer on the surface. The segment space 206 between the first blade 202*a* and the second blade 202*b* therefore prevents the separation effect between the surface of the blade units 202 and fluid.

Figure 4:
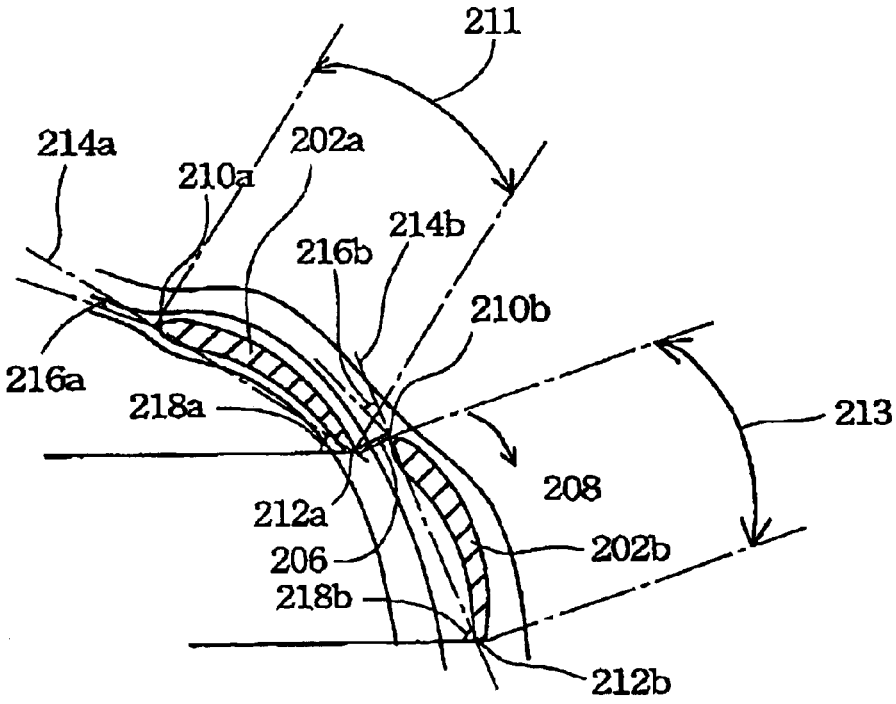
FIG. 4 illustrates a cross-sectional of a segment blade of the axial flow fan depicted in FIG. 3 in accordance with the present invention.
Figure 5:
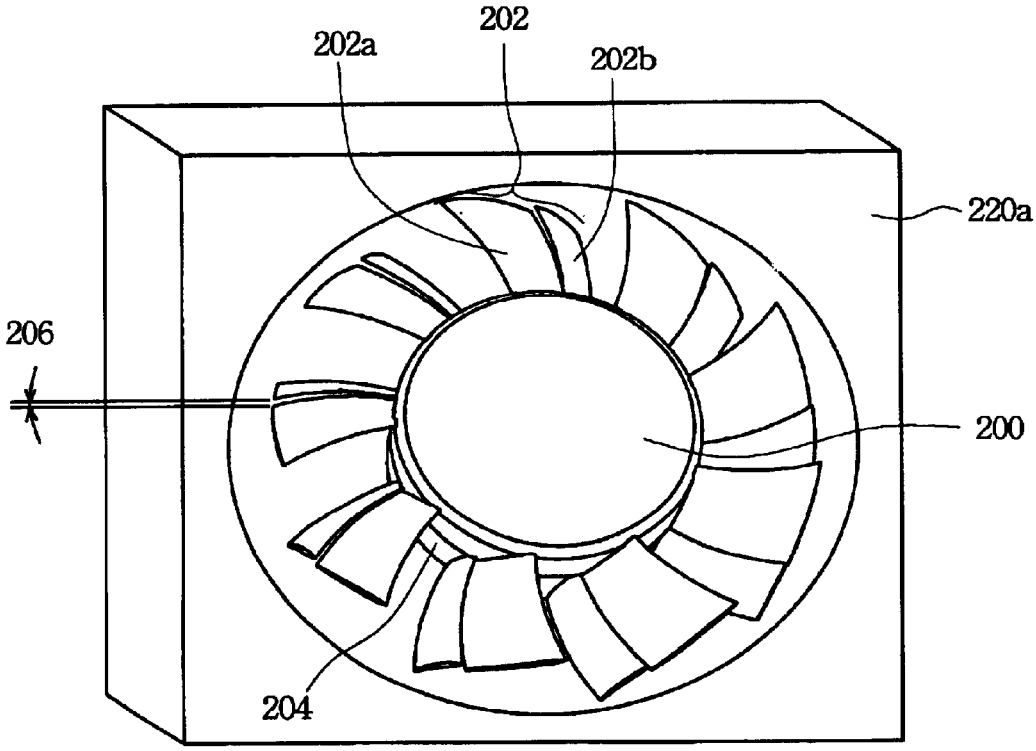
FIG. 5 illustrates a three-dimensional view of an axial flow fan with multiple segment blades in accordance with one preferred embodiment the present invention.

FIG. 4 shows a cross-sectional view of a segment blade of the axial flow fan in FIG. 3 in accordance with the present invention. The first blade 202*a* has a first leading edge 210*a* and a first rear edge 212*a* in each of blade units 202. The first leading edge 210*a* and the first rear edge 212*a* define a first chord line 214*a*. An angle between an entry direction of the fluid into the first leading angle 210*a* and the first chord line 214*a* is defined as a first incident angle ($A_1$) 216*a*. The first incident angle ($A_1$) 216*a* has arbitrary angles. Preferably, the first incident angle ($A_1$) 216*a* has a range of about $0° < A_1 \leqq 30°$ for a laminar flow when the fluid flows to the first rear edge 212*a*.

The second blade 202*b* has a second leading edge 210*b* and a second rear edge 212*b* to define a second chord line 214*b*. An angle between an entry direction of the fluid into the second leading edge 210*b* and the second chord line 214*b* is defined as a second incident angle ($A_2$) 216*b*. The second incident angle ($A_2$) 216*b* has arbitrary angles. The second incident angle ($A_2$) 216*b* preferably has a range of $0° < A_2 \leqq 30°$ to keep the fluid adjacent to the second rear edge laminar. In addition, the angle between the radius of the hub and the first or second chord line 214*a*, 214*b* is defined as installation angles 218*a*, 218*b*. The first incident angle 216*a* and the second incident angle 216*b* are generally proportional to the installation angle.

Specifically, the blade units 202 have a total incident angle equal to the sum of the first and the second incident angle 216*a*, 216*b*. Typically, the more incident angle of the blade unit induces more work resulting in increment of the operation efficiency of the axial flow fan. Each of the segment blades 202*a*, 202*b* has a maximum incident angle 216*a*, 216*b* to generate more work in the present invention when the fluid on the surface region of the segment blades 202*a*, 202*b* is a laminar flow. Moreover, the present invention utilizes a constant total incident angle to calculate and adjust respective incident angle of the segment blades 202*a*, 202*b* for an efficiency increment of the of the axial flow fan.

The present invention sequentially utilizes the first incident angle (A1) 216*a* of the first blade 202*a* and the second incident angle (A2) 216*b* of the second angle 202*b*. The second leading edge 210*b* of the second blade 202*b* absorbs the turbulence flow adjacent to the first rear edge 212*a* of the first blade 202*a* to eliminate disturbance for a fluid impact reduction against the surface regions of the first blades 202*a*, and the second blade 202*b*. The segment space 206 between the first blade 202*a* and the second blade 202*b* keeps the fluid passing over the surface of the first blade 202*a* and through the second blade 202*b* laminar. The segment space 206 in flow direction 208 creates a state of separation between the first blade 202*a* and the second blade 202*b*, that is to say, the first rear edge 212*a* of the first blade 202*a* does not overlap the second leading edge 210*b* of the second blade 202*b* in the flow direction 208. Alternatively, the segment space 206 in flow direction 208 can create a state of overlap between the first blade 202*a* and the second blade 202*b*, that is to say, the first rear edge 212*a* of the first blade 202*a* overlaps the second leading edge 210*b* of the second blade 202*b* in the flow direction 208. The segment space 206 in a direction perpendicular to the flow direction 208 creates a state of separation between the first blade 202*a* and the second blade 202*b* and the second blade 202*b* is in front of the upper surface of the first blade 202*a*, that is to say, the second leading edge 210*b* of the second blade 202*b* is in front of the first rear edge 212*a* of the first blade 202*a* in the direction perpendicular to the flow direction 208. Therefore, the second blade 202*b* introduces the fluid from the first blade 202*a*, and reforms a boundary layer of the fluid passed through the upper surface of the first blade 202*a* to reduce the thickness of the boundary layers on the upper surfaces of the first blade 202*a* and the second blade 202*b*. The segment space 206 between the first blade 202*a* and the second blade 202*b* therefore prevents the separation effect on the surfaces of the first blade 202*a* and the second blade 202*b*, and especially, prevents the separation effect on the upper surface of the first blade 202*a*.

The blade units 202 are connected to a periphery of the hub 200 and extended radially outward from the periphery. Each of the blade units has a first blade 202*a* and a second blade 202*b*. As segment space 206 is positioned between the first blade and the second blade to maintain a laminar flow of the fluid passing over a surface region of the first blade 202*a* and the second blade 202*b* by a boundary layer reformation on the surface of the segment blades.

When the axial flow fan is in operation in a specific direction, the segment blades absorb the fluid and each of the segment blades gradually compresses the fluid to transmit the fluid.

Figure 6:
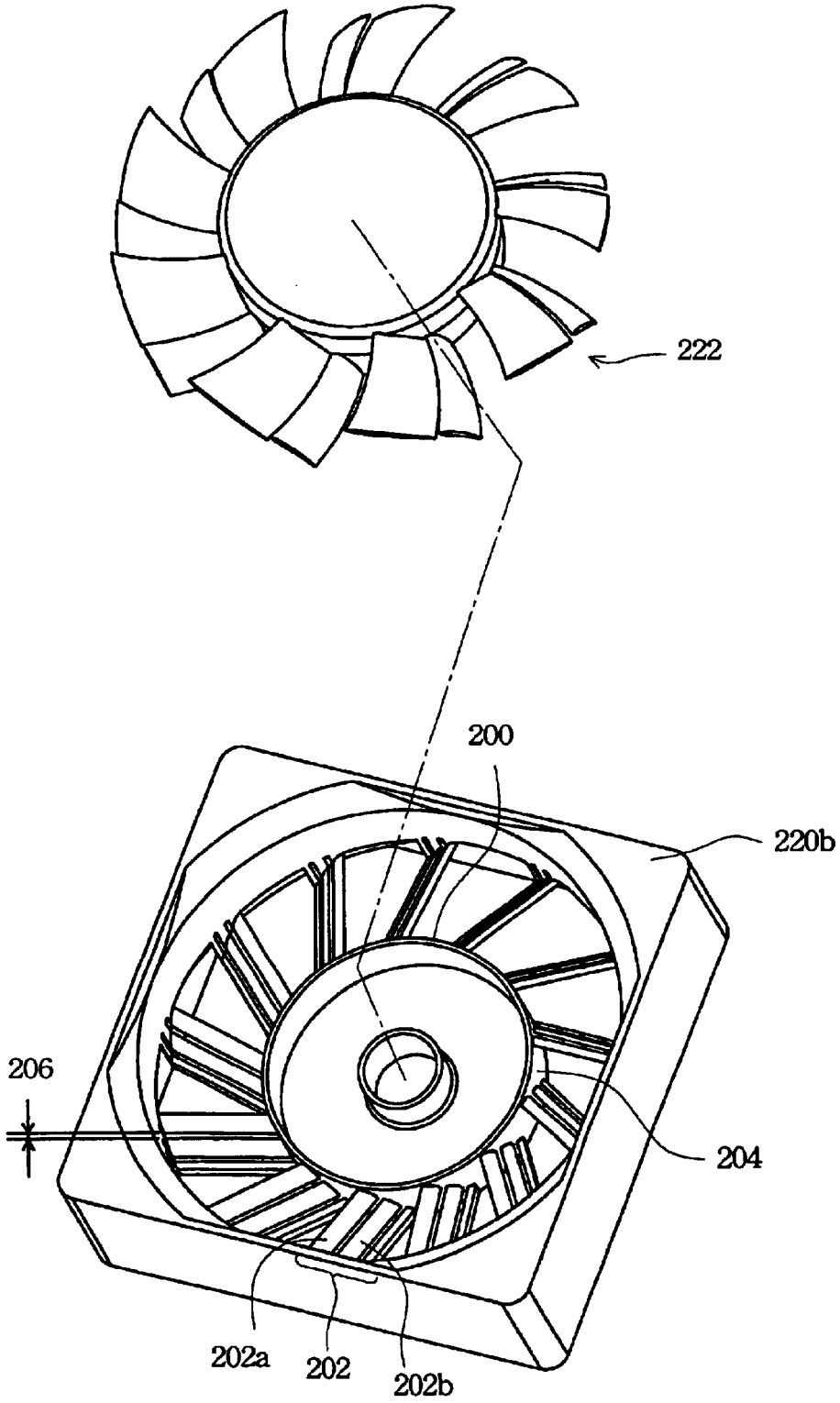
FIG. 6 illustrates a three-dimensional view of an axial flow fan with multiple segment blades in accordance with another preferred embodiment the present invention.

FIG. 6 shows a three-dimensional view of an axial flow fan with multiple segment blades in accordance with another preferred embodiment of the present invention. The axial flow fan with multiple segment blades has a frame base 220*b*, a plurality of rotating blade units 222, a hub 200 and a plurality of still blade units 202. The hub 200 pivots on the frame base 220*b* and the hub 200 has rotating blade units 222. The still blade units 202 mounted on the frame base 220*b* form a stationary structure and extend radially outward. As mentioned in the first embodiment of the present invention, each of the rotating blade units 222 also has a plurality of blades. The major feature of the second embodiment is that the still blade units 202 are fixed to the frame base 220*b* to form a steady structure. A segment space 206 between the first blade 202*a* and the second blade 202*b* maintains a laminar flow of the fluid passing over a surface region of the first blade 202*a* and the second blade 202*b*.

Typically, the axial flow fan utilizes the still blade units 202 and rotating blade units 222, such as the above-mentioned segment blades 202 or a single blade. The still blade units 202 mounted on the frame base align with the rotating blade units for assembly of the axial flow fan. The still blade units and the frame base are at rest when the axial flow fan is in operation. The fluid is then introduced into rotating blade units 222 so that the fluid is gradually compressed to transfer the fluid.

In the preferred embodiment of the present invention, a plurality of segment blades 202*a* , 202*b* are positioned along the transmission direction of the fluid and no additional size of the axial flow fan for the benefit of the manufacturing cost reduction. More importantly, the segment blades can be used to reduce resistance on the surface so as to decrease operation current of the axial flow fan for lower power consumption.

According to the above, the present invention utilizes an axial flow fan with multiple segment blades to introduce fluid by a plurality of blade units. A boundary layer of fluid passed through the segment blades is regenerated to reduce the thickness of the boundary layer on the blade surfaces. As a result, the separation between the blade surfaces and fluid is avoided to keep the fluid adjacent to the segment blades a laminar flow. Additionally, the total incident angles of a blade unit are divided into a plurality of incident angles of a segment blade to reduce fluid impact against the surface region of the blades. Furthermore, the fluid resistance reduction on the surface region of the segment blades can decrease the operation current of axial flow fan.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A blade structure with multiple segment blades, comprising:

a hub; and a plurality of blade units connected to a periphery of the hub and extending radially outward from the periphery, wherein each of the blade units at least includes a first blade and a second blade, and a segment space is positioned between the first blade and the second blade to maintain a laminar flow of fluid passing over a surface region of the first blade and the second blade, wherein the second blade is configured in front of an upper surface of the first blade in a direction perpendicular to a flow direction of the fluid, and has a leading edge positioned adjacent to a first rear edge of the first blade for introducing the fluid from the first blade and reforming a boundary layer of the fluid passed through the upper surface of the first blade so as to prevent a separation effect on the upper surface of the first blade.

2. The blade structure with multiple segment blades of claim 1, wherein the segment space between the first blade and the second blade in the flow direction of the fluid comprises a state of separation.

3. The blade structure with multiple segment blades of claim 1, wherein the segment space between the first blade and the second blade in the flow direction of the fluid comprises a state of overlap.

4. The blade structure with multiple segment blades of claim 1, wherein a first length of the first blade in a flow direction of the fluid is greater than a second length of the second blade along the flow direction.

5. The blade structure with multiple segment blades of claim 1, the first blade having a first leading edge and the first rear edge to define a first chord line, and a first incident angle (A1) being defined as an angle between an entry direction of the fluid into the first leading angle and the first chord line, wherein the first incident angle (A1) comprises a range of about $0° < A_1 \leqq 30°$ to keep a laminar flow of the fluid adjacent to the first rear edge.

6. The blade structure with multiple segment blades of claim 1, the second blade having the leading edge and a second rear edge to define a second chord line, and a second incident angle (A2) being defined as an angle between an entry direction of the fluid into the second leading angle and the second chord line, wherein the second incident angle (A2) comprises a range of about $0° < A_2 \leqq 30°$ to keep a laminar flow of the fluid adjacent to the second rear edge.

7. A blade structure with multiple segment blades, comprising:

a hub; and a plurality of blade units connected to a periphery of the hub and extending radially outward from the periphery, wherein each of the blade units at least includes a first blade and a second blade having a leading edge positioned adjacent to a first rear edge of the first blade, a first length of the first blade in a flow direction of the fluid is greater than a second length of the second blade in the flow direction, and a segment space between the first blade and the second blade maintains a laminar flow of fluid passing over an upper surface of the first blade, wherein the second blade is configured in front of the upper surface of the first blade in a direction perpendicular to the flow direction of the fluid.

8. The blade structure with multiple segment blades of claim 7, wherein the segment space between the first blade and the second blade in the flow direction of the fluid comprises a state of separation.

9. The blade structure with multiple segment blades of claim 7, wherein the segment space between the first blade and the second blade in the flow direction of the fluid comprises state of overlap.

10. The blade structure with multiple segment blades of claim 7, the first blade having a first leading edge and the first rear edge to define a first chord line, and a first incident angle (A1) being defined as an angle between an entry direction of the fluid into the first leading angle and the first chord line, wherein the first incident angle (A1) comprises a range of about $0° < A_1 \leqq 30°$ to keep a laminar flow of the fluid adjacent to the first rear edge.

11. The blade structure with multiple segment blades of claim 7, the second blade having the leading edge and a second rear edge to define a second chord line, and a second incident angle (A2) being defined as an angle between an entry direction of the fluid into the second leading angle and the second chord line, wherein the second incident angle (A2) comprises a range of about $0° < A_2 \leqq 30°$ to keep a laminar flow of the fluid adjacent to the second rear edge.

12. An axial flow fan with multiple segment blades, the axial flow fan comprising:

a frame base;

a hub disposed on the frame base to support the multiple segment blades; and a plurality of blade units connected to a periphery of the hub and extending radially outward from the periphery, wherein each of the blade units at least includes a first blade and a second blade having a leading edge positioned adjacent to a first rear edge of the first blade, and a segment space between the first blade and the second blade keeps a laminar flow of fluid passing over upper surfaces of the first blade and the second blade, wherein the second blade is configured in front of the upper surface of the first blade in a direction perpendicular to the flow direction of the fluid.

13. The axial flow fan with multiple segment blades of claim 12, wherein the segment space between the first blade and the second blade in the flow direction of the fluid comprises a state of separation.

14. The axial flow fan with multiple segment blades of claim 12, wherein the segment space between the first blade and the second blade in the flow direction of the fluid comprises a state of overlap.

15. The axial flow fan with multiple segment blades of claim 12, wherein a first length of the first blade in a flow direction of the fluid is greater than a second length of the second blade along the flow direction.

16. The axial flow fan with multiple segment blades of claim 12, the first blade having a first leading edge and the first rear edge to define a first chord line, and a first incident angle (A1) being defined as an angle between an entry direction of the fluid into the first leading angle and the first chord line, wherein the first incident angle (A1) comprises a range of about $0° < A_1 \leqq 30°$ to keep a laminar flow of the fluid adjacent to the first rear edge.

17. The axial flow fan with multiple segment blades of claim 12, the second blade having the leading edge and a second rear edge to define a second chord line, and a second incident angle (A2) being defined as an angle between an entry direction of the fluid into the second leading angle and the second chord line, wherein the second incident angle (A2) comprises a range of about $0° < A_2 \leqq 30°$ to maintain laminar flow of the fluid adjacent to the first rear edge.

18. The axial flow fan with multiple segment blades of claim 12, further comprising a plurality of stationary blade units mounted to the frame base and extended radially outward from the periphery to introduce fluid into the blade units, wherein each of the stationary blade units at least includes a first stationary blade and a second stationary blade, and a stationary segment space between the first stationary blade and the second stationary blade maintains a laminar flow of the fluid passing over upper surfaces of the first stationary blade and the second stationary blade, wherein the second stationary blade is configured in front of the upper surface of the first stationary blade in the direction perpendicular to the flow direction of the fluid.

* * * * *